US010357810B2

(12) United States Patent
Ruan et al.

(10) Patent No.: US 10,357,810 B2
(45) Date of Patent: Jul. 23, 2019

(54) STEADY FLOW STRUCTURE AND A VENTILATION APPARATUS HAVING SAID STEADY FLOW STRUCTURE

(71) Applicant: E3 Green Technology Co., LTD., Shanghai (CN)

(72) Inventors: Hongzheng Ruan, Shanghai (CN); Guangye Tang, Naperville, IL (US)

(73) Assignee: E3 GREEN TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 15/549,643

(22) PCT Filed: Apr. 1, 2016

(86) PCT No.: PCT/CN2016/078290
§ 371 (c)(1),
(2) Date: Aug. 8, 2017

(87) PCT Pub. No.: WO2017/156802
PCT Pub. Date: Sep. 21, 2017

(65) Prior Publication Data

US 2018/0065161 A1 Mar. 8, 2018

(30) Foreign Application Priority Data

Mar. 17, 2016 (CN) ..... 2016 1 0152404

(51) Int. Cl.
*B08B 15/02* (2006.01)
*F24F 3/16* (2006.01)
(Continued)

(52) U.S. Cl.
CPC ..... *B08B 15/02* (2013.01); *B08B 15/023* (2013.01); *F24F 3/1607* (2013.01); *F24F 7/06* (2013.01);
(Continued)

(58) Field of Classification Search
USPC ..... 454/56, 58, 192, 193
See application file for complete search history.

(56) References Cited

U.S. PATENT DOCUMENTS 2,627,220 A * 2/1953 Morrow ..... B08B 15/023 454/57
2,819,666 A * 1/1958 McNeil ..... B08B 15/023 126/299 R
(Continued)

FOREIGN PATENT DOCUMENTS

CN 201865683 U 6/2011
CN 204710833 U 10/2015
(Continued)

OTHER PUBLICATIONS

Written Opinion of the International Searching Authority dated Dec. 29, 2016 for International Application No. PCT/CN2016/078290, 4 pages.
(Continued)

*Primary Examiner* — Steven B McAllister
*Assistant Examiner* — Frances F. Hamilton
(74) *Attorney, Agent, or Firm* — Knobbe, Martens, Olson & Bear, LLP

(57) ABSTRACT

The present invention provides a steady flow structure and a ventilation apparatus having the steady flow structure. The ventilation apparatus comprises: a hood arranged indoors, an inner chamber of the hood constituting a work chamber; and a front wall of the hood formed with a front opening which opens towards the indoor environment; an air supply duct, which supplies air into the work chamber through air supply outlets provided on the hood and extending in the left and right width direction of the work chamber; and an air exhaust duct, through which the air entering the work chamber through the front opening and the air entering the work chamber through the air supply outlets are exhausted
(Continued)

from the work chamber to outside; a steady flow structure is provided in the interior of the air supply duct, supply airflow enters into the steady flow structure in the left-right directions, and then blows out evenly and stably along the air supply outlets located along the sides of the steady flow structure after flowing through the steady flow structure.

19 Claims, 11 Drawing Sheets

(51) Int. Cl.
*F24F 7/06* (2006.01)
*F24F 13/08* (2006.01)
*F24F 13/24* (2006.01)

(52) U.S. Cl.
CPC ..... *F24F 13/08* (2013.01); *B08B 2215/003* (2013.01); *F24F 13/24* (2013.01)

(56) References Cited

U.S. PATENT DOCUMENTS 3,251,177 A * 5/1966 Baker ..... B25H 1/20 454/56
3,279,883 A * 10/1966 Thompson ..... A61G 13/108 422/4
3,318,227 A * 5/1967 Nelson ..... B08B 15/023 454/59
3,604,333 A * 9/1971 Nelson ..... B08B 15/023 454/59
3,771,323 A * 11/1973 Simons ..... A47F 3/0447 454/193
3,897,721 A * 8/1975 Fuhst ..... B08B 15/023 454/59
4,177,717 A * 12/1979 Grow ..... B08B 15/023 422/567
4,434,711 A * 3/1984 Zboralski ..... B08B 15/02 454/62
4,785,722 A * 11/1988 Dollhopf ..... B08B 15/023 454/62
5,138,843 A * 8/1992 Tamayama ..... A47F 3/0447 62/256
5,675,983 A * 10/1997 Ibrahim ..... A47F 3/0408 62/255
6,290,266 B1 * 9/2001 Kawano ..... F15D 1/04 138/39
6,428,408 B1 * 8/2002 Bell ..... B01L 1/50 454/56
7,531,017 B2 * 5/2009 Ryan ..... B01L 1/50 454/187
8,251,406 B2 * 8/2012 Kawano ..... F15D 1/04 138/39
2005/0164622 A1 * 7/2005 Ryan ..... B08B 15/023 454/56
2008/0153409 A1 * 6/2008 Koop ..... B01F 3/02 454/261
2012/0052784 A1 * 3/2012 Smith ..... B08B 15/02 454/56

FOREIGN PATENT DOCUMENTS

CN 204934175 U 1/2016
CN 205536442 U 8/2016
KR 100613765 B1 8/2006
KR 20090017044 A 2/2009
WO 2016161834 A1 10/2016

OTHER PUBLICATIONS

International Search Report dated Dec. 29, 2016 for International Application No. PCT/CN2016/078290, 5 pages.

* cited by examiner

STEADY FLOW STRUCTURE AND A VENTILATION APPARATUS HAVING SAID STEADY FLOW STRUCTURE

CROSS REFERENCE TO RELATED APPLICATIONS

This application is the U.S. National Phase Application under 35 U.S.C. § 371 of International Application No. PCT/CN2016/078290, filed Apr. 1, 2016, designating the U.S. which claims the benefit of Chinese Patent Application No. 201610152404.1, filed Mar. 17, 2016, which is hereby incorporated by reference in their entirety.

BACKGROUND OF THE INVENTION

Field of the Invention

The present invention relates to a ventilation apparatus for industrial or commercial use. More specifically the invention relates to an air supplying type ventilation apparatus with a steady flow structure used in the ventilation apparatus.

Description of Related Art

Ventilation apparatus is generally described as apparatus for removing gases, such as exhaust gases, harmful gases and particulates, from work spaces to outside (usually outdoors), and the apparatus is widely used in both industry and daily life. For example, in factories where toxic and harmful gases or particles are generated during industrial production, in biological and chemical laboratories of research institutions, in kitchens where cooking fumes are generated, and the like, all need ventilation apparatus to exhaust toxic gases and particles from work spaces to outdoors.

In most of the conventional ventilation apparatus, a hood is provided with a work chamber (work space enclosure) to contain and dispose harmful airborne substances, and large amounts of ambient indoor air is supplied into the work chamber through a front opening of the hood while a high-power fan exhausts air from the work chamber. For most of the conventional ventilation apparatus, since the ambient indoor air supplied into the work chamber is clean and comfortable air-conditioned air for ensuring comfortable and safe indoor work environment, buildings equipped with the conventional ventilation apparatus consume enormous amounts of air conditioning energy. In addition, unpredictable and inconsistent airflow patterns, such as turbulent vortexes, frequently form around the front opening of the hood and the exhaust outlet. In this situation, regardless of the velocity of air supplied from the front opening, as long as turbulence or vortexes exist in the structure of air inside the work chamber of the ventilation apparatus, there is a risk of overflow, which may threaten the health and safety of the indoor workers. CN Patent ZL201520216778.6 discloses a fume hood (ventilation apparatus), wherein by providing air supply outlets at the upper or lower side of the hood, supply airflow obtained from the air supply system of the building is blown into the work chamber of the fume hood. This design may significantly reduce the energy consumption of building air conditioning due to the air supply structure. However, since there is no specific device for controlling flow directions at each air supply outlet of the fume hood disclosed in the patent, the supply airflows from air supply outlets may flow in arbitrary directions, and the supply airflows flow freely in the air supply duct, as a result, a large proportion of the supply airflows flowing out of the air supply outlets would be turbulent or disturbed flows. Thus, the risk of overflow, which threatens the health and safety of indoor workers, still exist. Furthermore, the supply airflows flowing freely in the air supply duct generates loud noise levels in the air supply duct, which significantly reduces the comfort in the indoor environment where the fume hood is used.

SUMMARY OF THE INVENTION

In order to solve the problems in existing ventilation apparatus, such as airflow from the air supply outlets are non-directional and consists of mostly turbulent or disturbed flows, and to reduce the undesirable noise levels in existing ventilation apparatus, the present invention provides a steady flow structure and a ventilation apparatus having the steady flow structure. The steady flow structure is comprised of multiple substantial L-shaped flow-guiding plates, each flow-guiding plate includes an air catching plate which is one side of the L-shape and a longitudinal plate which is the other side of the L-shape; wherein, all of the flow-guiding plates are arranged in a straight line, with longitudinal plates of the flow-guiding plates being arranged in parallel with each other and all of the air catching plates of the flow-guiding plates facing a same direction in which airflow enters; ends of the longitudinal plates of all of the flow-guiding plates are aligned with each other, and lengths of the longitudinal plates are increased along the direction in which the airflow enters; both sides of all the flow-guiding plates are seamlessly jointed to walls constructing the airflow duct so as to form airflow paths separated by the flow-guiding plates for directing the airflow from the air catching plates to the respective airflow paths and blown out along the longitudinal plates.

Preferably, all the flow-guiding plates in the steady flow structure provided by the present invention are arranged in a straight line with constant intervals.

Preferably, heights of all of the flow-guiding plates in the steady flow structure provided by the present invention increase with equal differences along the direction in which the airflow enters.

The steady flow structure provided by the present invention as described above, can create a significant steady flow effect on airflow in the duct, and reduce airflow noise levels, thereby providing a smooth and steady airflow output.

The present invention provides a ventilation apparatus, comprised of: a hood arranged indoors, an inner chamber of the hood constituting a work chamber, with the front wall of the hood being formed with a front opening facing towards the indoor environment; an air supply duct, which supplies air into the work chamber through air supply outlets which are provided on the hood extending in the left and right width direction of the work chamber; and an air exhaust duct, through which air entering into the work chamber through the front opening and air entering the work chamber through the air supply outlets are exhausted from the work chamber to outside; a steady flow structure is provided in the interior of the air supply duct and the steady flow structure is comprised of multiple flow-guiding plates formed in a substantial L-shape, each flow-guiding plate includes an air catching plate which is one side of the L-shape and a longitudinal plate which is the other side of the L-shape; wherein, all of the flow-guiding plates are arranged in a straight line, with longitudinal plates of the flow-guiding plates being arranged in parallel with each other and all of the air catching plates of the flow-guiding plates facing a same direction in which airflow enters; ends of the longitudinal plates of all of the flow-guiding plates are aligned with each other, and lengths of the longitudinal plates are increased along the direction in which the airflow enters; both sides of all the flow-guiding plates are seamlessly jointed to walls constructing the airflow duct so as to form airflow paths separated by the flow-guiding plates for directing the airflow from the air catching plates to the respective airflow paths and blown out along the longitudinal plates; when air is supplied through the steady flow structure it blows out evenly and stably from the air supply outlets located along the side of the steady flow structure.

Further, according to the ventilation apparatus of the present invention, all of the flow-guiding plates of the steady flow structure are arranged in a straight line with constant intervals.

Further, according to the ventilation apparatus of the present invention, the heights of all of the flow-guiding plates of the steady flow structure increase with equal differences along the direction in which the airflow enters.

Preferably, according to the ventilation apparatus of the present invention, two of the aforementioned steady flow structures are provided symmetrically in left and right at the interior of the air supply outlet, and the two steady flow structures are arranged in a straight line and form a configuration having a larger height in the middle than at left and right ends; the supply airflow is supplied into the left and right ends, respectively, and then, after flowing through the steady flow structures, blows out evenly and stably from the air supply outlets located along the sides of the two steady flow structures.

More preferably, a central separator plate is provided between the two steady flow structures, at the center position of the straight line, and is provided in parallel with the longitudinal plates of all the flow-guiding plates. Each side of the central separator plate is seamlessly jointed to walls constituting the air supply duct, such that supply airflow entering the steady flow structures from the left direction and from the right direction are separated from each other.

Preferably, the ventilation apparatus provided by the present invention comprises an air supply outlet located at the upper portion of the front opening of the work chamber and inside of the work chamber, wherein the air supply outlet supplies the air obliquely and downwardly towards the interior of the work chamber.

More preferably. the ventilation apparatus provided by the present invention further comprises another air supply outlet located at the lower portion of the front opening of the work chamber, wherein said another air supply outlet supplies air towards the interior of the work chamber.

Further, according to the ventilation apparatus provided by the present invention, wherein the steady flow structure further comprises of air outlet guide plates orthogonal to the longitudinal plates of all of the flow-guiding plates and inside the air supply outlet, so as to change the direction from which the airflow enters out from the air supply outlet.

Preferably, the ventilation apparatus provided by the present invention further comprises a third air supply outlet located at the upper portion of the front opening of the work chamber and outside of the work chamber, wherein the third air supply outlet supplies the air downwardly.

Further, according to the ventilation apparatus provided by the present invention, each air supply outlet is provided with a mesh grille for covering the air supply outlet.

Preferably, according to the ventilation apparatus provided by the present invention, the another air supply outlet described above is further provided with a mesh screen covering the mesh grille, each screen hole of the mesh screen has a smaller area than each grille hole of the mesh grille, thereby preventing foreign objects from falling into the another air supply outlet.

Further, according to the ventilation apparatus provided by the present invention, an air supply inlet of the air supply duct is provided above the work chamber, all the airflow in the air supply duct are supplied into the ventilation apparatus through the air supply inlet.

Further, according to the ventilation apparatus provided by the present invention, left and right side walls of the hood are hollow structures respectively, connecting the air supply inlet with the air supply outlet located at the lower portion of the work chamber.

Further, according to the ventilation apparatus provided by the present invention, the air exhaust duct is located within the work chamber and near the rear portion of the hood, the air exhaust duct extends in left-right width direction of the work chamber, an air exhaust outlet of the air exhaust duct is provided above the work chamber, thereby the airflow entering into the air exhaust duct is exhausted to the outside of the work chamber.

Preferably, according to the ventilation apparatus provided by the present invention, the air exhaust duct is constituted by the hood and three air baffles, which are an upper, a middle and a lower air baffle at the rear portion of the work chamber, wherein the lower air baffle is vertically arranged at the lower portion of the lower chamber, with a plurality of through holes perforating the lower air baffle, and the plurality of through holes are distributed over the entire left-right width direction of the lower air baffle; the middle air baffle is located above the lower air baffle, and is provided obliquely in the direction towards the rear wall of the hood; the upper air baffle is located above the middle air baffle, and is provided obliquely in the direction towards the upper wall of the hood; gaps are provided between the three air baffles, and between the three air baffles and inner walls of the hood; airflow in the work chamber flows into the air exhaust duct through the aforementioned through holes and the gaps, and is exhausted through the air exhaust outlet to outdoors.

More preferably, according to the ventilation apparatus provided by the present invention, the work chamber is provided with an inclined top wall, which is provided from the one air supply outlet towards the upper air baffle gap between the top wall of the hood.

More preferably, according to the ventilation apparatus provided by the present invention, wherein a work light is provided within the inclined top wall for illuminating the work chamber.

According to the ventilation apparatus provided by the present invention, it is necessary for the supply airflow to pass through the steady flow structure before blowing out from the air supply outlets, the flow-guiding plates provided in a straight line on the steady flow structure divides and regulates the supply airflow, greatly reducing the proportion of turbulent flow in the supply airflow; the air outlet guide plate provided on the steady flow structure further defines the directions of the airflow blowing out from the air supply outlets, therefore, a stable airflow that has been divided and regulated is delivered into the work chamber in desired directions; the air supply outlets provided within the work chamber supplies even and stable air towards the interior of the work chamber, and pushes indoor environment airflow entering into the work chamber from the front opening of the hood, as well as toxic gases, cooking fumes or particles and the like within the hood, into the air exhaust duct in an even and stable manner; further, the air supply outlet provided outside of the work chamber supplies air downwards vertically, and the airflow blowing out downwards can further reduce the risk that the workers outside of the hood breathe in harmful substances, and the airflow blowing out downwards forms an "Air Curtain", which functions as a buffer between air inside of the work chamber and outside of the hood, effectively preventing the risk of overflow; gaps are provided between the three air baffles in the air exhaust duct, and between the three air baffles and inner wall of the hood, providing a further inlet for the airflow to enter into the air exhaust duct as compared with ventilation apparatus in prior art, such that the airflow within the work chamber can flow into the air exhaust duct and flow out through the air exhaust outlet without going through a long climbing path, therefore reducing the possibility of turbulent airflow forming within the work chamber. According to the ventilation apparatus provided by the present invention, based on even and stable air supply and air exhaust, an effective push-pull system is established within the work chamber, and toxic gases within the work chamber may be effectively and quickly exhausted, rather than relying on high-powered air exhaust which conventional ventilation apparatus requires. Experiments show that in the ventilation apparatus provided by the present invention, the air exhaust amount is 80% compared to air supply type ventilation apparatus meeting American performance standards on the market, and two-thirds of the air exhaust amount in the present invention comes from the air supply duct, greatly reducing the indoor air conditioning energy consumption in which the ventilation apparatus is located; the overall energy saving efficiency may be up to 83%; and according to the ventilation apparatus provided by the present invention, due to the low the air exhaust amount and the stable airflow, work noise is significantly reduced and the noise in a full work load state is merely 50 dB.

Figure 1:
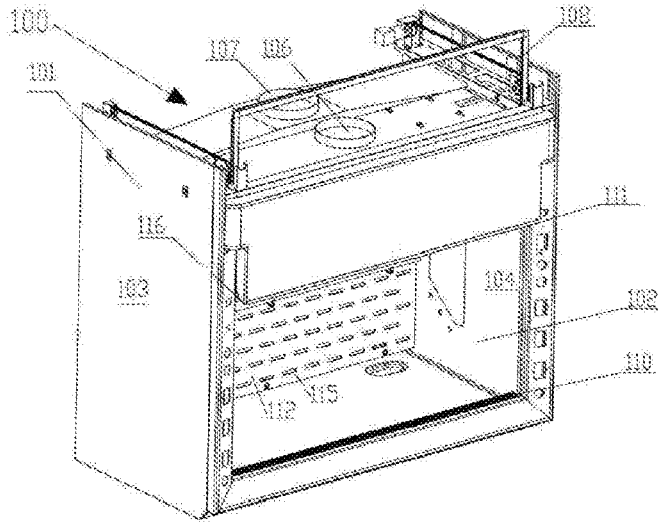
FIG. 1 is a perspective schematic illustration showing a preferred embodiment of the ventilation apparatus provided by the present invention.

| Description of the reference number |
|---|
| 100 ventilation apparatus |
| 101 hood 102 work chamber 103 left side wall 104 right side wall |
| 105 rear wall 106 air supply inlet 107 air exhaust outlet |
| 108 front window |
| 119 top panel |
| 1061 air supply duct 1062, 1063, 1064 flow-dividing sheet |
| 1065 airflow path |
| 109 first air supply outlet 110 second air supply outlet |
| 111 third air supply outlet 116 mesh grille 118 inclined top wall |
| 191 work light 120, 121 steady flow structure |
| 1201 (1201a, 1201b, 1201c, 1201d, 1201e) flow-guiding plate |
| 12011 air catching plate 12012l longitudinal plate |
| 1202 central separator plate |
| 1203 air outlet guide plate |
| 1071 air exhaust duct |
| 112 lower air baffle 113 middle air baffle 114 upper air baffle |
| 115 through hole |

DETAILED DESCRIPTION OF THE INVENTION

The preferred embodiment of the present invention will be described in accordance with the accompanying drawings. Although the present invention will be described in combination with the preferred embodiment, it is understood that the features of this invention are not limited to the preferred embodiment. On the contrary, the purpose of presenting the present invention in combination with the preferred embodiments is to cover other alternatives or modifications that may be derived from the claims of the present invention. The following description will include abundant specific details to facilitate a deeper understanding of the present invention. The present invention may also be implemented without using these details. In addition, some specific details will be omitted in the description so as to avoid confusion and missing the key points of the present invention.

In addition, the terms "up", "down", "left", "right", "top" and "bottom" used in the following description are defined referring to the spatial position in which the ventilation apparatus is used by the indoor worker and should not be construed as limiting the present invention. Further, in order to clearly show the distributions of the airflow directions inside and outside of the ventilation apparatus provided by the present invention, arrows are added in several accompanying drawings to indicate the directions of the airflows at which the arrows are located.

First Embodiment

Figure 2:
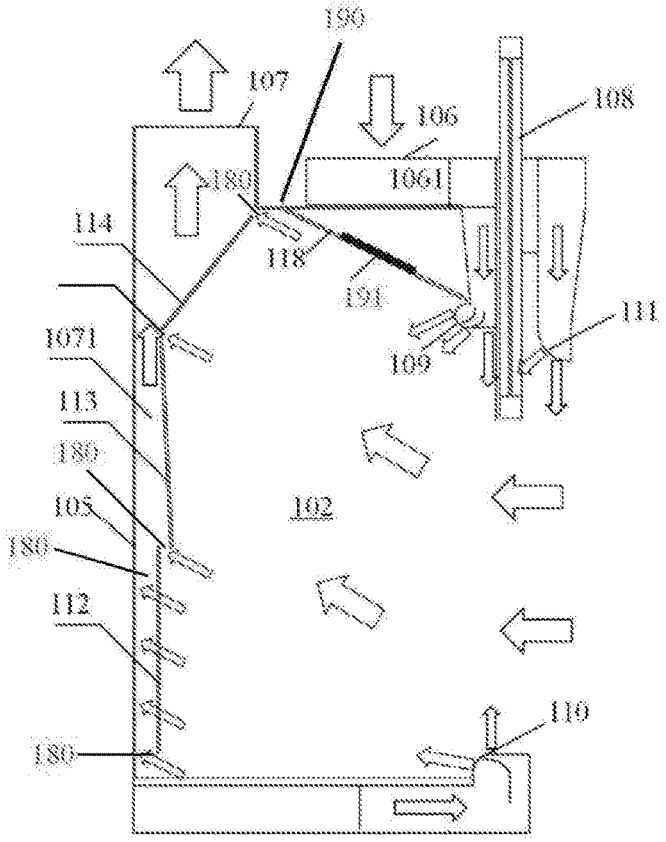
FIG. 2 is a schematic illustration showing airflow orientations of the preferred embodiment of the ventilation apparatus provided by the present invention.

FIG. 1 is a perspective view showing an appearance of the first embodiment of the ventilation apparatus provided by the present invention. FIG. 2 shows the airflow orientations in the work chamber of the ventilation apparatus, and the specific airflow orientations are indicated by the various arrows placed thereon. An inner chamber of the hood 101 of the ventilation apparatus 100 forms the work chamber 102; the hood 101 comprises: a left side wall 103, a right side wall 104, a rear wall 105, and a front window 108, which when opened forms a front opening that opens to the indoor environment; and at the top of the hood 101, an air supply inlet 106 for providing supply airflow to an air supply duct 1061 and an air exhaust outlet 107 for exhausting airflow entered into an air exhaust duct 1071 to outdoors are provided.

Figure 3:
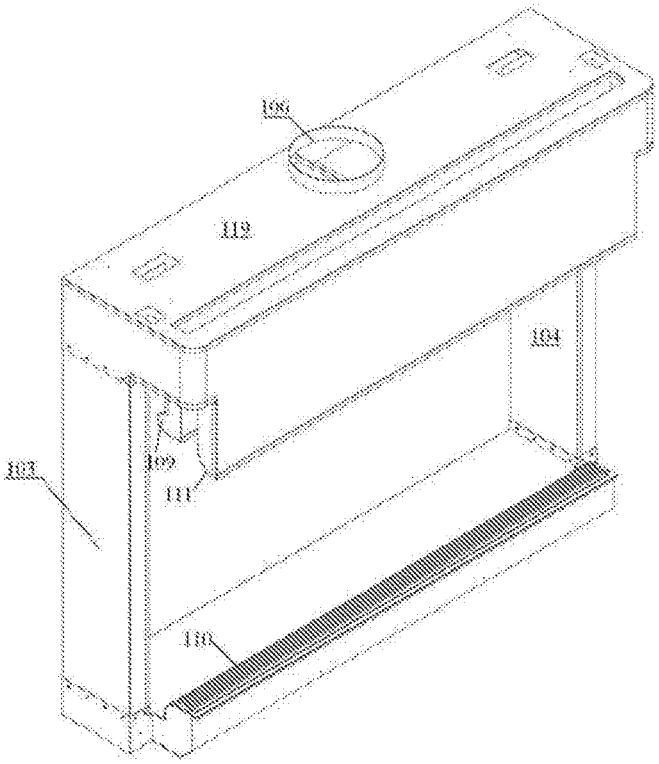
FIG. 3 is a perspective schematic illustration showing the air supply duct of the preferred embodiment of the ventilation apparatus provided by the present invention.
Figure 4A:
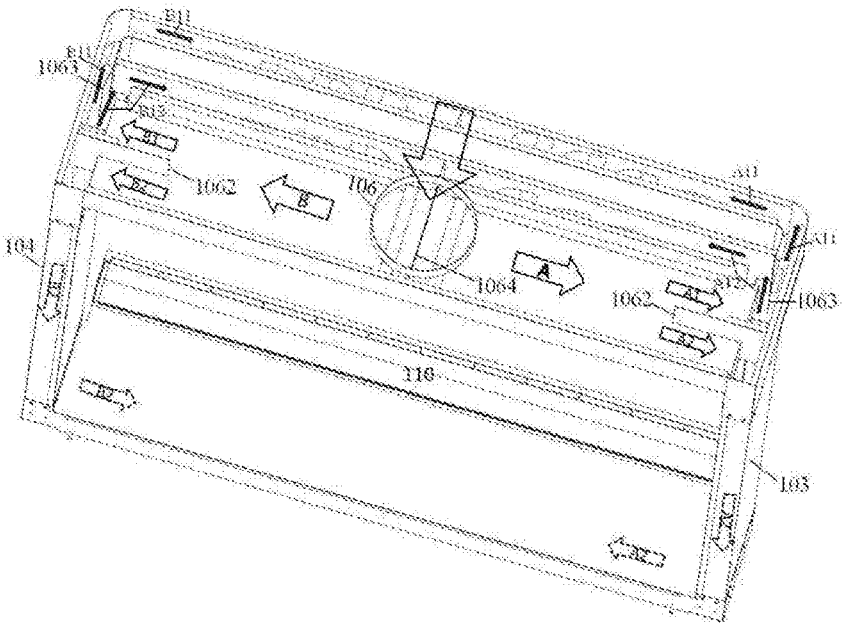
FIG. 4*a* is a perspective schematic illustration showing the air supply duct at the top of the hood of the preferred embodiment of the ventilation apparatus provided by the present invention.
Figure 4B:
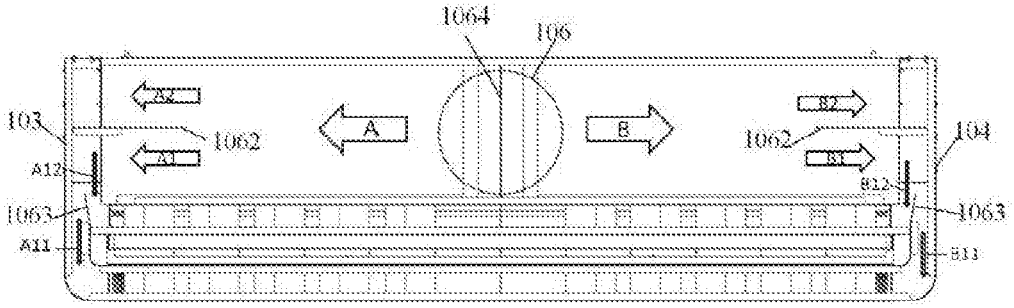
FIG. 4*b* is a front view illustrating the air supply duct at the top of the hood of the preferred embodiment of the ventilation apparatus provided by the present invention.

FIG. 3 is a schematic illustration showing the exterior structure of the entire air supply duct inside the ventilation apparatus 100. The hood 101 is provided with three air supply outlets: a first air supply outlet 109 is located at the upper portion of the front opening of the work chamber 102 and inside of the work chamber 102, and as shown in FIG. 2, supplies the air obliquely and downwardly towards the interior of the work chamber; a second air supply outlet 110 is located at the lower portion of the front opening of the work chamber 102, and as shown in FIG. 2, supplies the air towards the interior of the work chamber, and a third air supply outlet 111 is located at the upper portion of the front opening of the work chamber 102 and outside the work chamber 102, and as shown in FIG. 2, supplies the air downward vertically. In order to clearly show the specific direction of the airflow after the supply airflow enters into the air supply duct of the hood from the air supply inlet 106 located at the top of the hood, FIG. 4*a* and FIG. 4*b* shows the configuration of the air supply duct 1061 near the air supply inlet 106 when a top panel 119 of the hood 101 is opened; as indicated by the arrows in FIG. 4, after being supplied downward vertically from the air supply inlet 106, the supply airflow is split below the air supply inlet 106 into two paths A and B by a flow-dividing sheet 1064, and flows to left and right sides of the hood; then, at a position near the left and right side walls of the hood, the supply airflow is split again into two paths, i.e., front and rear paths by the flow-dividing sheet 1062, that is, the left path airflow A is split by the flow-dividing sheet 1062 into a front path airflow A1 and a rear path airflow A2, and the right path airflow B is split by the flow-dividing sheet 1062 into a front path airflow B1 and a rear path airflow B2; after colliding with the left and right side walls 103, 104 respectively, the front path airflows A1, B1 are restricted by the side walls and corresponding air supply duct walls, thus redirected to flow forwardly where they are split once again by a flow-dividing sheet 1063 into left and right paths; the airflow A1 is split into an airflow A11 and an airflow A12, the airflow B1 is split into an airflow B11 and an airflow B12; the airflow A11 and the airflow B11 flow into the air supply duct near the third air supply outlet from the left and right ends of the hood respectively; the airflow A12 and the airflow B12 flow into the air supply duct near the first air supply outlet from the left and right ends of the hood respectively; the hood side walls 103 and 104 of the ventilation apparatus 100 are of a hollow double layer structure, the rear path airflows A2 and B2 flow downwardly after colliding with the left and right side walls 103,104, and are guided by the hollow structured side walls towards and close to the second air supply outlet.

Figure 5A:
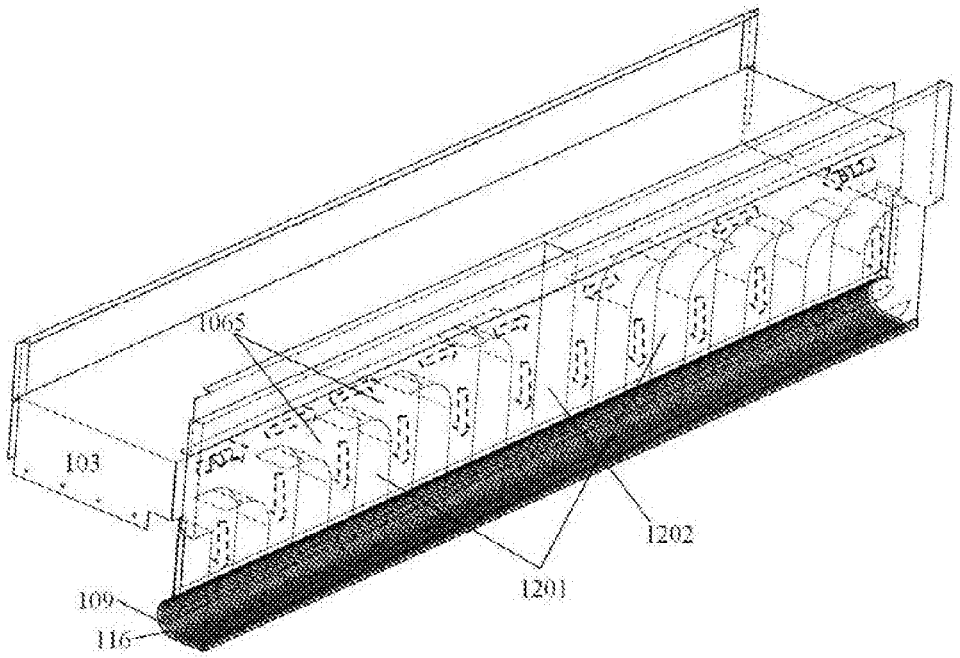
FIG. 5*a* is a perspective schematic illustration showing the structure near the first air supply outlet according to the preferred embodiment of the ventilation apparatus provided by the present invention.

The ventilation apparatus 100 is provided with two steady flow structures on the inner side of each air supply outlet, before the supply airflow blows out from the air supply outlets, to rectify turbulent flow and control airflow directions, thus to ensure that the supply air blowing out from each air supply outlet are steady flows along predetermined directions. FIG. 5 is schematic view of the structure near the first air supply outlet 109. As shown in FIG. 5*a*, after flowing through two steady flow structures 120 and 121 (see FIG. 5*d*) which are reflectionally symmetrical, the supply airflow A12 and B12 from the left and right sides of the hood are split by the steady flow structures into a plurality of airflow paths 1065, and led by an air outlet guide plate 1203 shared by the two steady flow structures to finally blow out from the air supply outlet 109.

Figure 5B:
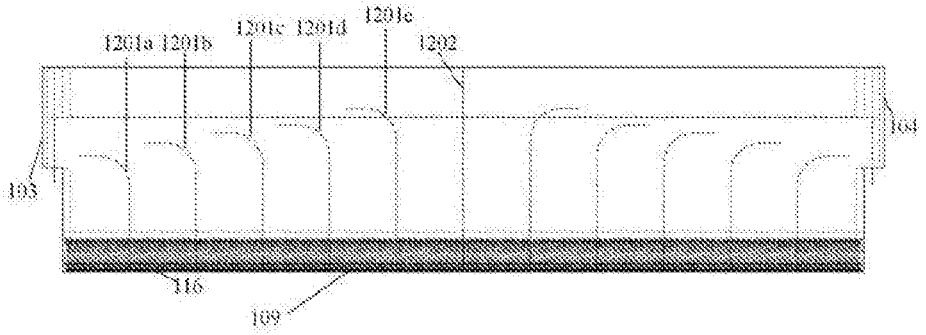
FIG. 5*b* is a front view illustrating the structure near the first air supply outlet according to the preferred embodiment of the ventilation apparatus provided by the present invention.
Figure 5C:
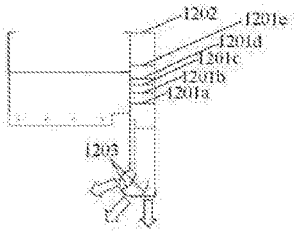
FIG. 5*c* is a left view illustrating the structure near the first air supply outlet according to the preferred embodiment of the ventilation apparatus provided by the present invention.
Figure 5D:
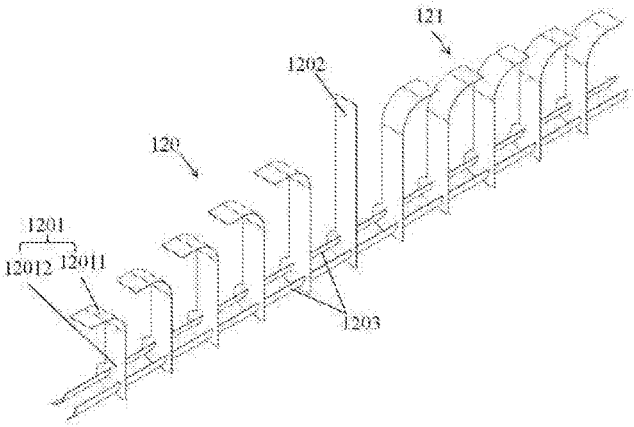
FIG. 5*d* is a perspective view of the steady flow structure near the first air supply outlet according to the preferred embodiment of the ventilation apparatus provided by the present invention.

The configurations of the steady flow structures 120 and 121 are shown in FIG. 5*d* wherein the two steady flow structures 120 and 121 are arranged to be reflectionally symmetrical in left and right, each steady flow structure comprises a plurality of flow-guiding plates 1201 formed in a substantial L-shape, each flow-guiding plate 1201 includes an air catching plate 12011 which is one side of the L-shape and a longitudinal plate 12012 which is the other side of the L-shape; all the flow-guiding plates 1201 are arranged in a straight line, with the longitudinal plates 12012 of the flow-guiding plates being arranged in parallel with each other and all the air catching plates 12011 of the flow-guiding plates facing a same direction in which the airflow enters; ends of the longitudinal plates 12012 of all of the flow-guiding plates are aligned with each other, and lengths of the longitudinal plates are increased along the direction in which the airflow enters; both sides of all of the flow-guiding plates 1201 are seamlessly jointed to walls constructing the airflow duct so as to form airflow paths separated by the flow-guiding plates for directing the airflow from the air catching plates to the respective airflow paths 1065 and blown out along the longitudinal plates.

Further, a central separator plate 1202 is provided between the aforementioned two steady flow structures 120 and 121, the central separator plate is placed at the center position of the aforementioned straight line, and in parallel with the longitudinal plates of all the flow-guiding plates, with each side of the central separator plate seamlessly jointed to the air supply duct walls such that the supply airflows entering into the steady flow structures from the left direction and from the right direction are separated from each other.

Preferably, all the flow-guiding plates 1201 of the two steady flow structures 120 and 121 and the central separator plate 1202 are arranged in a straight line with constant intervals, and the heights of all of the flow-guiding plates 1201 of the two steady flow structures 120 and 121 are increased with equal differences along the direction in which the airflows enters (from 1201*a* to 1201*e*).

Still further, the steady flow structures 120 and 121 comprises two (commonly used) air outlet guide plates 1203 shaped as an arc, the air outlet guide plates are orthogonal to the longitudinal plates 12012 of all the flow-guiding plates, so as to change the directions of the airflows blown out from the air supply outlet.

More preferably, the air supply outlet 109 is provided with a mesh grille 116 covering the air supply outlet.

Since both sides of each flow-guiding plate 1201 of the steady flow structures and all the sides of the central separator plates 1202 are seamlessly jointed to the air supply duct walls, as shown in FIG. 5*a*, after flowing in from the left end of the steady flow structure 120 and the right end of the steady flow structure 121 (see FIG. 5*d*), the supply airflows A12 and B12 are respectively caught by the air catching plates 12011 of the flow-guiding plates in different heights into airflow paths 1065 constructed by corresponding flow-guiding plates and air supply duct walls; at the place where the directions of airflows are changed, the air catching plates 12011 are designed with arched surfaces for smoothly changing the directions of the airflows, preventing the formation of turbulent flows to the highest degree. FIG. 5*b* and Sc are the front view and the left view of the structure near the first air supply outlet 109 respectively, the steady flow structures 120 and 121 (see FIG. 5*d*) are both provided with five flow-guiding plates 1201*a*-1201*e* with the heights gradually decreasing from 1201*e* to 1201*a*, thus, the supply airflows A12 and B12 are caught by the flow-guiding plates with different heights and are split into six branches as they flow towards the central separator plate 1202, the six branches each flow downwardly along the L-shape configuration of their corresponding flow-guiding plates. After the supply airflows A12 and B12 are split by six airflow paths 1065 respectively, their flow rates are decreased and most of the turbulent flows are corrected by the flow-guiding plates into uniform laminar flows, and redirected to the directions indicated by arrows shown in FIG. 5*c* by the arc-shaped air outlet guide plates 1203, which are provided orthogonally with the longitudinal plates of all the flow-guiding plates and inside of the air supply outlet 109, and blows into the work chamber obliquely and downwardly from air supply outlet 109; the supply airflows in these directions effectively push the toxic gases located interiorly near the central portion of the work chamber. The mesh grille 116 arranged at the air supply outlet 109 further diffuse the supply airflows, thus to further ensure that uniform stable laminar airflows are supplied from the air supply outlet 109 to the work chamber.

FIG. 6 is a schematic view of the structure near the second air supply outlet 110. As shown in FIG. 6*a*, through the hollow side walls 103 and 104 at the left and right sides of the hood, the supply airflows A2 and B2 flowing in from the left and right sides of the hood are split by the steady flow structures into multiple airflow paths after flowing through the two symmetrical steady flow structures 120 and 121 (see FIG. 6*d*), and finally, along the direction of the air outlet guide plate of the steady flow structure 120, blown out from the air supply outlet 110.

Figure 6A:
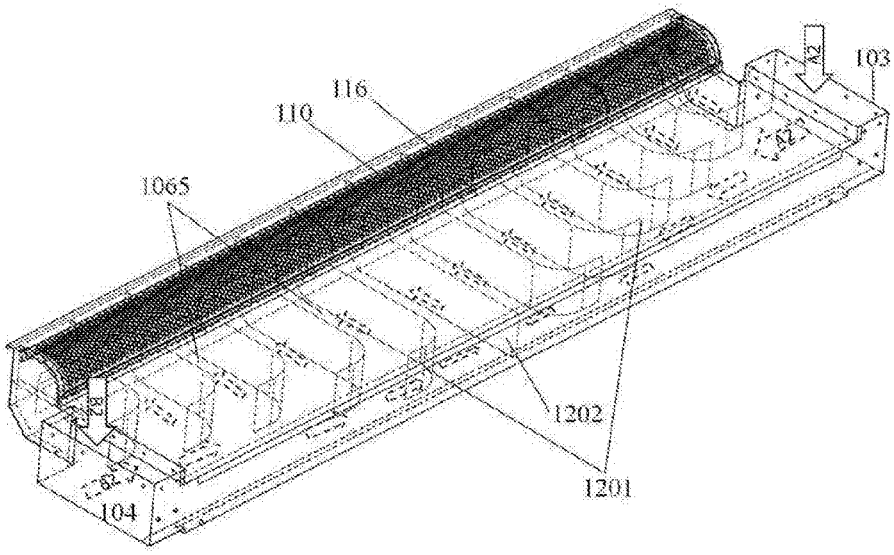
FIG. 6*a* is a perspective schematic illustration showing the structure near the second air supply outlet according to the preferred embodiment of the ventilation apparatus provided by the present invention.
Figure 6B:
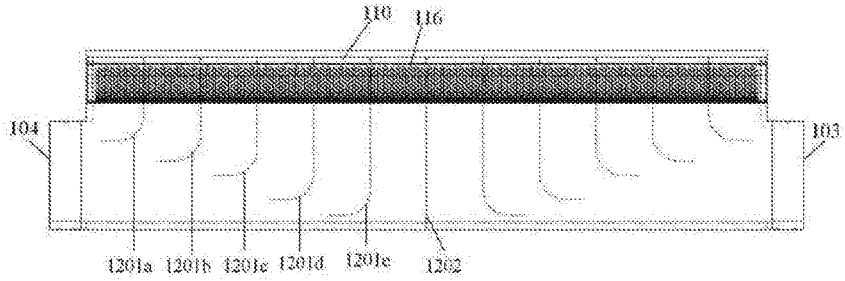
FIG. 6*b* is a front view illustrating the structure near the second air supply outlet according to the preferred embodiment of the ventilation apparatus provided by the present invention.
Figure 6C:
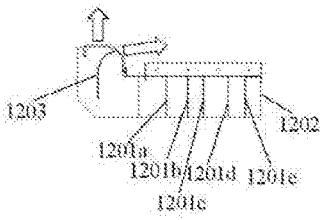
FIG. 6*c* is a left view illustrating the structure near the second air supply outlet according to the preferred embodiment of the ventilation apparatus provided by the present invention.
Figure 6D:
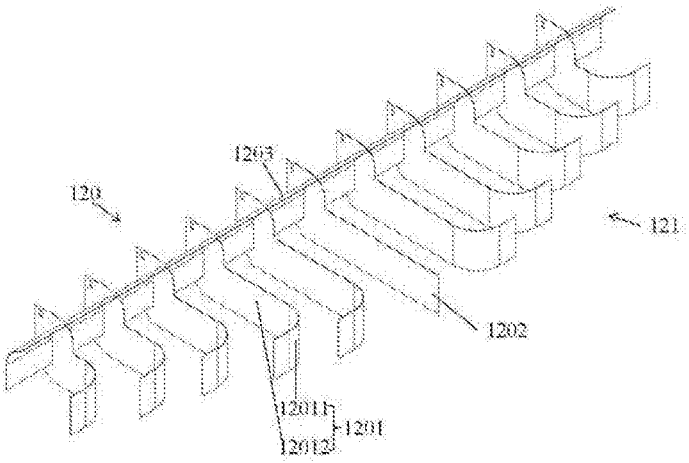
FIG. 6*d* is a perspective view of the steady flow structure near the second air supply outlet according to the preferred embodiment of the ventilation apparatus provided by the present invention.

The configurations of the steady flow structures 120 and 121 are shown in FIG. 6*d* wherein the two steady flow structures 120 and 121 are arranged to be reflectionally symmetrical in left and right, each steady flow structure comprises a plurality of flow-guiding plates 1201 formed in a substantial L-shape, each flow-guiding plate 1201 include an air catching plate 12011 which is one side of the L-shape and a longitudinal plate 12012 which is the other side of the L-shape; all the flow-guiding plates 1201 are arranged in a straight line, with the longitudinal plates 12012 of the flow-guiding plates being arranged in parallel with each other and all the air catching plates 12011 of the flow-guiding plates facing a same direction in which the airflow enters; ends of the longitudinal plates 12012 of all of the flow-guiding plates are aligned with each other, and lengths of the longitudinal plates are increased along the direction in which the airflow enters; both sides of all of the flow-guiding plates 1201 are seamlessly jointed to walls constructing the airflow duct so as to form airflow paths separated by the flow-guiding plates for directing the airflow from the air catching plates to the respective airflow paths 1065 and blown out along the longitudinal plates.

Further, a central separator plate 1202 is provided between the aforementioned two steady flow structures 120 and 121, the central separator plate is placed at the center position of the aforementioned straight line, and in parallel with the longitudinal plates of all the flow-guiding plates, with each side of the central separator plate seamlessly jointed to the air supply duct walls such that the supply airflows entering into the steady flow structures from the left direction and from the right direction are separated from each other.

Preferably, all the flow-guiding plates 1201 of the two steady flow structures 120 and 121 and the central separator plate 1202 are arranged in a straight line with constant intervals, and the heights of all of the flow-guiding plates 1201 of the two steady flow structures 120 and 121 is increased with equal differences along the direction in which the airflows enter (from 1201*a* to 1201*e*).

Still further, the steady flow structures 120 and 121 comprise two (commonly used) air outlet guide plates 1203 shaped as an arc, the air outlet guide plates are orthogonal to the longitudinal plates 12012 of all the flow-guiding plates, so as to change the directions of the airflows blown out from the air supply outlet.

More preferably, the air supply outlet 110 is provided with a mesh grille 116 covering the air supply outlet, and a mesh screen covering the mesh grille is provided on the outside of the mesh grille 116, each screen hole of the mesh screen has a smaller area than each grille hole of the mesh grille. As operators such as research experiment workers frequently stand in front of the air supply outlet 110 to operate the apparatus, the design of the mesh screen with small holes can prevent foreign material from falling into the said air supply outlet.

Since both sides of each flow-guiding plate 1201 of the steady flow structures and all the sides of the central separator plates 1202 are seamlessly jointed to the air supply duct walls, as shown in FIG. 6*a*, after flowing in from the left end of the steady flow structure 120 and the right end of the steady flow structure 121 (see FIG. 6*d*), the supply airflows A2 and B2 are respectively caught by the air catching plates 12011 of the flow-guiding plates in different heights into airflow paths 1065 constructed by corresponding flow-guiding plates and air supply duct walls; at the place where the directions of airflows are changed, the air catching plates 12011 are designed with arched surfaces for smoothly changing the directions of the airflows, preventing the formation of turbulent flows to the highest degree. FIGS. 6*b* and 6*c* are the front view and the left view of the structure near the second air supply outlet 110 respectively, the steady flow structures 120 and 121 (see FIG. 6*d*) are both provided with five flow-guiding plates 1201*a*-1201*e* with the heights gradually decreasing from 1201*e* to 1201*a*, thus, the supply airflows A2 and B2 are caught by the flow-guiding plates with different heights and are split into six branches as they flow towards the central separator plate 1202, the each six branches flow backwardly along the L-shape configuration of their corresponding flow-guiding plates. After the supply airflows A2 and B2 are split by six airflow paths 1065 respectively, their flow rates are decreased and then most of the turbulent flows are corrected by the flow-guiding plates into uniform laminar flows, and redirected to the directions indicated by arrows shown in FIG. 6*c* by the arc-shaped air outlet guide plates 1203, which are provided orthogonally with the longitudinal plates of all the flow-guiding plates and inside of the air supply outlet 110, and blows obliquely and upwardly into the work chamber; the supply airflows in these directions effectively push the toxic gases located interiorly near the central portion of the work chamber. The mesh grille 116 and the mesh screen 117 arranged at the air supply outlet 110 further diffuse the supply airflows, thus to further ensure that uniform stable laminar airflows are supplied from the air supply outlet 110 to the work chamber.

FIG. 7 is a schematic view of the structure near the third air supply outlet 111. As shown in A FIG. 7*a*, through the hollow side walls 103 and 104 at the left and right sides of the hood, the supply airflows A11 and B11 flowing in from the left and right sides of the hood are split by the steady flow structures into multiple airflow paths after flowing through the two symmetrical steady flow structures 120 and 121 (see FIG. 7*d*), and finally, along the direction of the air outlet guide plate of the steady flow structure 120, blown out from the air supply outlet 111.

Figure 7A:
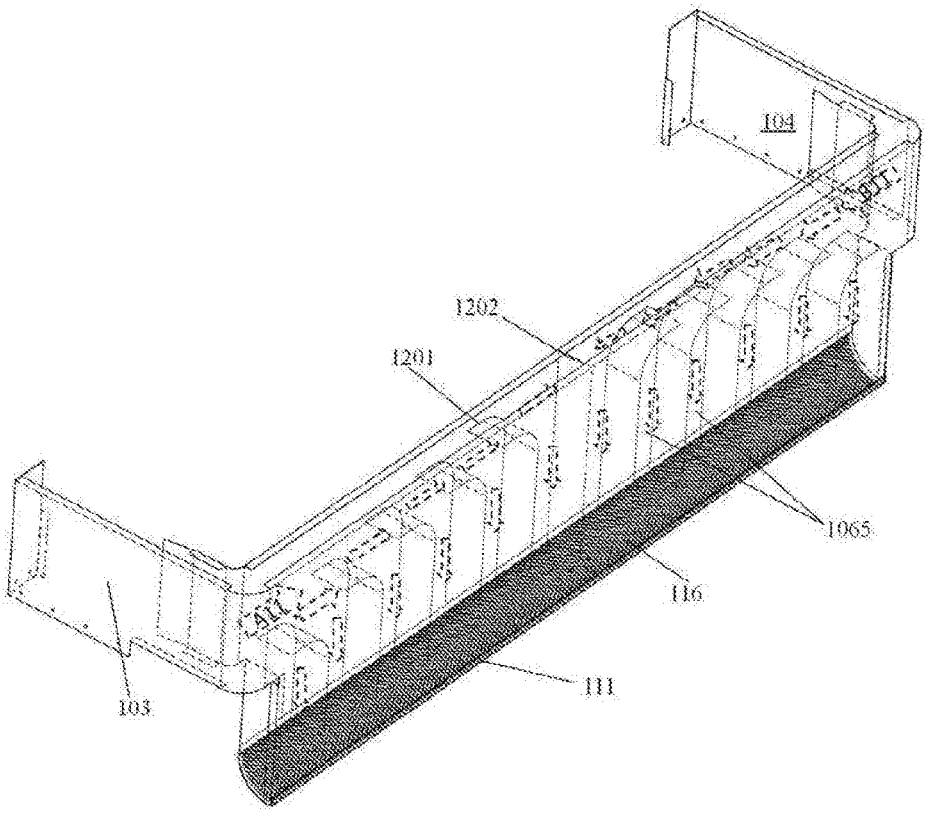
FIG. 7*a* is a perspective schematic illustration showing the structure near the third air supply outlet according to the preferred embodiment of the ventilation apparatus provided by the present invention.
Figure 7B:
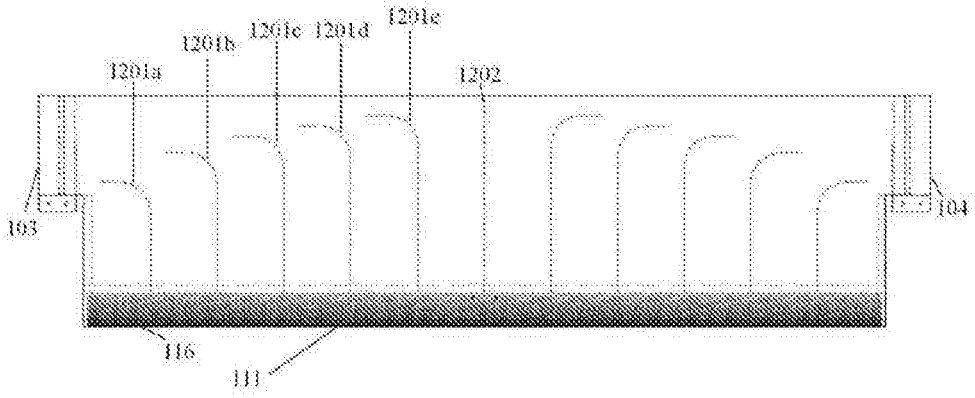
FIG. 7*b* is a front view illustrating the structure near the third air supply outlet according to the preferred embodiment of the ventilation apparatus provided by the present invention.
Figure 7C:
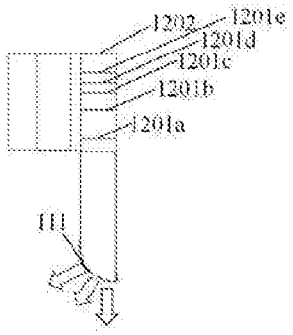
FIG. 7*c* is a left view illustrating the structure near the third air supply outlet according to the preferred embodiment of the ventilation apparatus provided by the present invention.
Figure 7D:
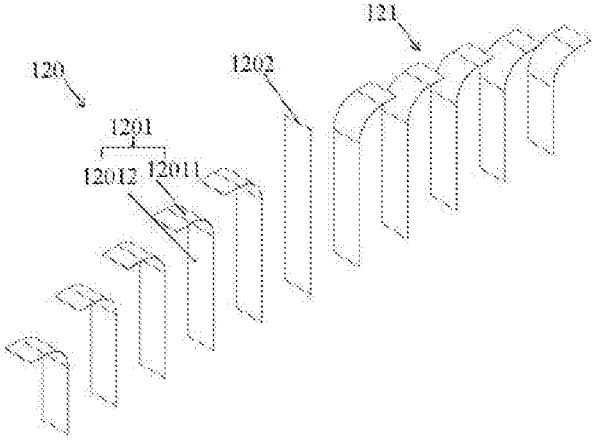
FIG. 7*d* is a perspective view of the steady flow structure near the third air supply outlet according to the preferred embodiment of the ventilation apparatus provided by the present invention.

The configurations of the steady flow structures 120 and 121 are shown in FIG. 7*d* wherein the two steady flow structures 120 and 121 are arranged to be reflectionally symmetrical in left and right, each steady flow structure comprises a plurality of flow-guiding plates 1201 formed in a substantial L-shape, each flow-guiding plate 1201 include an air catching plate 12011 which is one side of the L-shape and a longitudinal plate 12012 which is the other side of the L-shape; all the flow-guiding plates 1201 are arranged in a straight line, with the longitudinal plates 12012 of the flow-guiding plates being arranged in parallel with each other and all the air catching plates 12011 of the flow-guiding plates facing a same direction in which the airflow enters; ends of the longitudinal plates 12012 of all of the flow-guiding plates are aligned with each other, and lengths of the longitudinal plates are increased along the direction in which the airflow enters; both sides of all of the flow-guiding plates 1201 are seamlessly jointed to walls constructing the airflow duct so as to form airflow paths separated by the flow-guiding plates for directing the airflow from the air catching plates to the respective airflow paths 1065 and blown out along the longitudinal plates.

Further, a central separator plate 1202 is provided between the aforementioned two steady flow structures 120 and 121, the central separator plate is placed at the center position of the aforementioned straight line, and in parallel with the longitudinal plates of all the flow-guiding plates, with each side of the central separator plate seamlessly jointed to the air supply duct walls such that the supply airflows entering into the steady flow structures from the left direction and from the right direction are separated from each other.

Preferably, all the flow-guiding plates 1201 of the two steady flow structures 120 and 121 and the central separator plate 1202 are arranged in a straight line with constant intervals, and the heights of all of the flow-guiding plates 1201 of the two steady flow structures 120 and 121 is increased with equal differences along the direction in which the airflows enter (from 1201*a* to 1201*e*).

Still further, the steady flow structures 120 and 121 comprise two (commonly used) air outlet guide plates 1203 shaped as an arc, the air outlet guide plates are orthogonal to the longitudinal plates 12012 of all the flow-guiding plates, so as to change the directions of the airflows blown out from the air supply outlet.

More preferably, the air supply outlet 111 is provided with mesh grille 116 covering the air supply outlet.

Since both sides of each flow-guiding plate 1201 of the steady flow structures and all the sides of the central separator plates 1202 are seamlessly jointed to the air supply duct walls, as shown in FIG. 7*a*, after flowing in from the left end of the steady flow structure 120 and the right end of the steady flow structure 121 (see FIG. 7*d*), the supply airflows A11 and B11 are respectively caught by the air catching plates 12011 of the flow-guiding plates in different heights into airflow paths 1065 constructed by corresponding flow-guiding plates and air supply duct walls; at the place where the directions of airflows are changed, the air catching plates 12011 are designed with arched surfaces for smoothly changing the directions of the airflows, preventing the formation of turbulent flows to the highest degree. FIGS. 7*b* and 7*c* are the front view and the left view of the structure near the third air supply outlet 111 respectively, the steady flow structures 120 and 121 (see FIG. 7*d*) are both provided with five flow-guiding plates 1201*a*-1201*e* with the heights gradually decreasing from 1201*e* to 1201*a*, thus, the supply airflows A11 and B11 are caught by the flow-guiding plates with different heights and are split into six branches as they flow towards the central separator plate 1202, the each six branches flow downwardly along the L-shape configuration of corresponding flow-guiding plates. After the supply airflows A11 and B11 are split by six airflow paths 1065 respectively, their flow rates are decreased and then most of the turbulent flows are corrected by the flow-guiding plates into uniform laminar flows, and redirected to the directions indicated by arrows shown in FIG. 7*c* by the arc-shaped air outlet guide plates 1203, which are provided orthogonally with the longitudinal plates of all the flow-guiding plates and inside of the air supply outlet 111, and blows downwardly from the air supply outlet 111 into the work chamber; the airflow blowing out downwardly is located at the breathing-zone of hood operators, this will further reduce the risk of operators inhaling harmful substances, in addition, the airflow blowing out downwardly from the air supply outlet 111 forms an "Air Curtain", which functions as a buffer between air inside of the work chamber 102 and outside of the hood, effectively preventing the risk of overflow. The mesh grille 116 arranged at the air supply outlet 111 further diffuse the supply airflows, thus to further ensure that uniform stable laminar airflows are supplied from the air supply outlet 111 to the work chamber.

Figure 8:
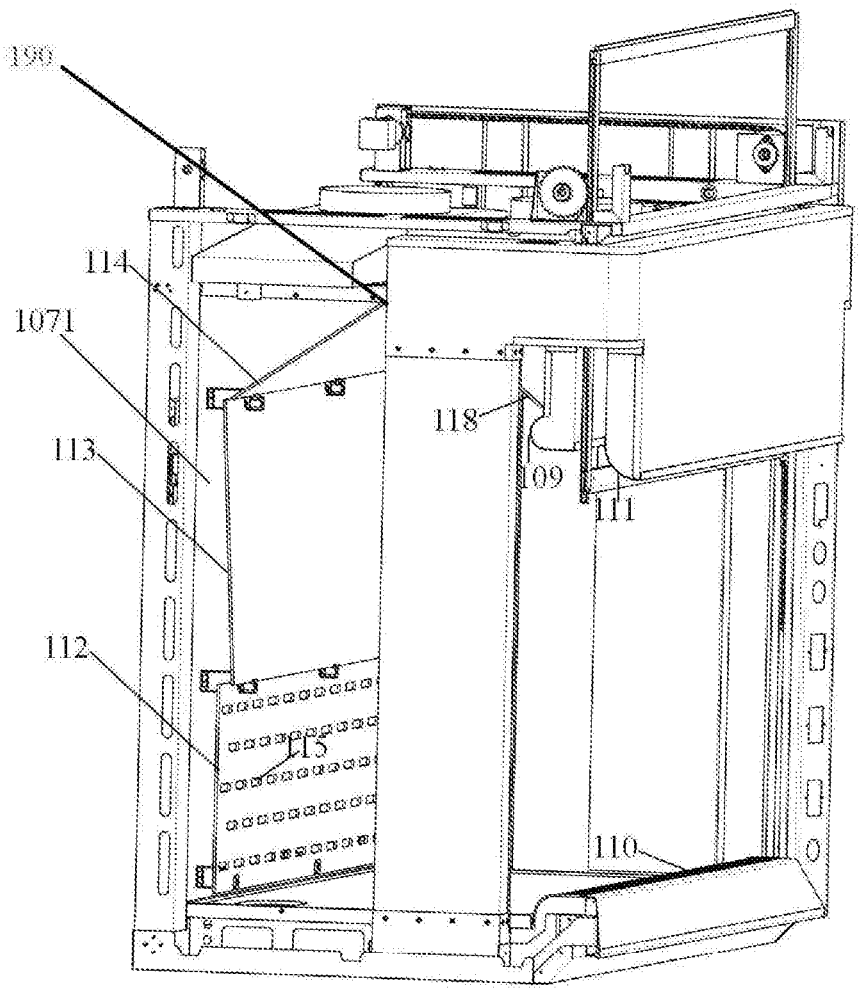
FIG. 8 is a perspective schematic illustration showing the structure near the air exhaust duct of embodiments of the ventilation apparatus provided by the present invention.

FIG. 8 shows the construction of the air exhaust duct 1071 of the ventilation apparatus 100 after a part of the side walls of the ventilation apparatus 100 is removed. Near the rear wall 105 of the hood inside of the work chamber 102, there are three air baffles, which are an upper 114, a middle 113 and a lower air baffles 112, and the air exhaust duct 1071 is constituted by the hood and the three air baffles, wherein the lower air baffle 112 has a plurality of through holes 115 opened thereon, and the plurality of through holes 115 are distributed over the entire left-right width direction of the lower air baffle 112; the middle air baffle 113 is located above the lower air baffle 112, and is provided obliquely in the direction towards the rear wall 105 of the hood; the upper air baffle 114 is located above the middle air baffle 113, and is provided obliquely in a direction towards the upper wall 190 of the hood (see FIG. 2); gaps are provided among the three air baffles, and between the three air baffles and inner walls of the hood 101; airflow in the work chamber flows into the air exhaust duct through the through holes 115 and the gaps 180, and is exhausted through the air exhaust outlet 107 to outdoors. According to ventilation apparatus in prior art, air is exhausted only through the hole at the lower portion of the work chamber and an air exhaust outlet region at the upper portion of the work chamber, therefore the airflow at the central portion of the work chamber needs to go through a long climbing path to be exhausted from the air exhaust outlet region at the upper portion of the work chamber, which requires high-powered exhaust, in addition, high-velocity exhaust around the large exhaust outlet region can easily lead to turbulent flow near the exhaust outlet region. According to the ventilation apparatus 100 of the present invention, in addition to the through holes 115 at the bottom, a plurality of horizontally extending exhaust gaps for exhausting is provided, so as to allow the airflow at different heights inside of the work chamber to quickly flow into the air exhaust duct 1071 and be exhausted without going through a long climbing path, thus exhaust power energy consumption is reduced; according to the ventilation apparatus 100 of the embodiments in the present invention, a plurality of gaps is applied to replace the large exhaust outlet region, and divides the airflow entering the air exhaust duct at multiple positions, which prevents the generation of turbulent flows, and stabilizes the exhaust airflow; in addition, since the exhaust gaps extend horizontally, the airflows in the work chamber are pushed by the supply airflow in a near horizontal form parallel to the surface; thereby establishing an effective push-pull airflow system.

The arrows in FIG. 2 indicate how the air flows into, through and out of the hood of the ventilation apparatus. The supply airflow enters the air supply duct 1061 from the air supply inlet 106, and flows to each of the air supply outlets 109, 110 and 111, and enters into the work chamber 102 along the direction indicated by the arrows; meanwhile, a portion of environment air also enters into the work chamber 102 from the front opening at an angle perpendicular to the front opening. As indicated by the arrows, after entering into the work chamber 102, the air will be pushed and pulled evenly by supply airflow and exhaust airflow towards the air exhaust duct 1071, and then be exhausted from the air exhaust outlet 107 at the top of the hood along the direction indicated by the arrows. Technical workers in this art would clearly understand: with respect to airflow, changes in the flow area causes flow speed to variate. Thus, the air entering from the front opening may slow down as it enters into the larger region of the work chamber 102, and speed up as it continues to flow near the air exhaust outlet. This variation in flow speed helps to maintain a uniform, stable push-pull system of air supply and air exhaust. Since the steady flow structure is provided at each air supply outlet, supply airflows entering into the work chamber 102 from each air supply outlet are all laminar flows, this can significantly reduce the amount of supply air required as well as the risk of turbulent flows formed by air within the hood. Further, in this embodiment, the work chamber 102 comprises an inclined top wall 118 inclining from the first air supply outlet 109 toward the upmost exhaust gap, wherein both sides of the inclined top wall 118 are jointed to the left and right side walls 103,104 of the hood, the bottom end thereof is jointed to the upper edge of the first air supply outlet 109, and the top end thereof is jointed to the top wall. Due to exhaust devices operating with high air exhaust amounts, in conventional fume hoods, vortexes are usually formed at the inner top portion of the work chamber, thus the toxic and harmful gases are unable to be exhausted. The design of the inclined top wall 118 can prevent the vortex from expanding, and in conjunction with the laminar airflows supplied out from the first air supply outlet 109 at the inner top of the work chamber 102, enables the airflow within the hood to ascend towards the air exhaust region slowly and evenly along the inclined wall. The angle and shape of the inclined top wall 118 are designed to help control and prevent the overflow of harmful substances in the air inside of the work chamber 102, and to reduce the likelihood of vortex formations at the top of the work chamber 102. Meanwhile, the inclined top wall can also be integrated with a flat-panel work light for illuminating the work chamber, which exempts the need to set up work light in other locations of the work chamber, and is simple and elegant.

Second Embodiment

Figure 9:
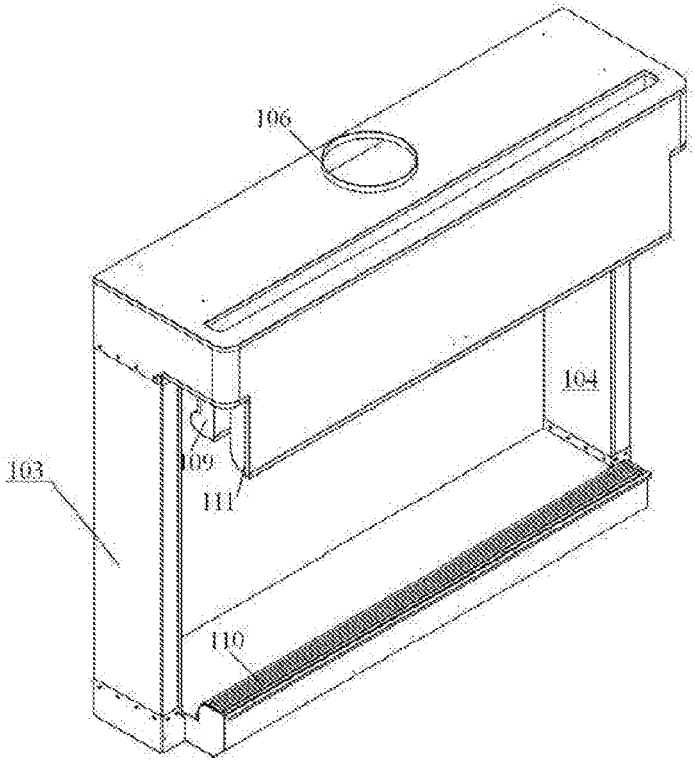
FIG. 9 is a schematic illustration showing the air supply duct of the second embodiment of the ventilation apparatus provided by the present invention.
Figure 10:
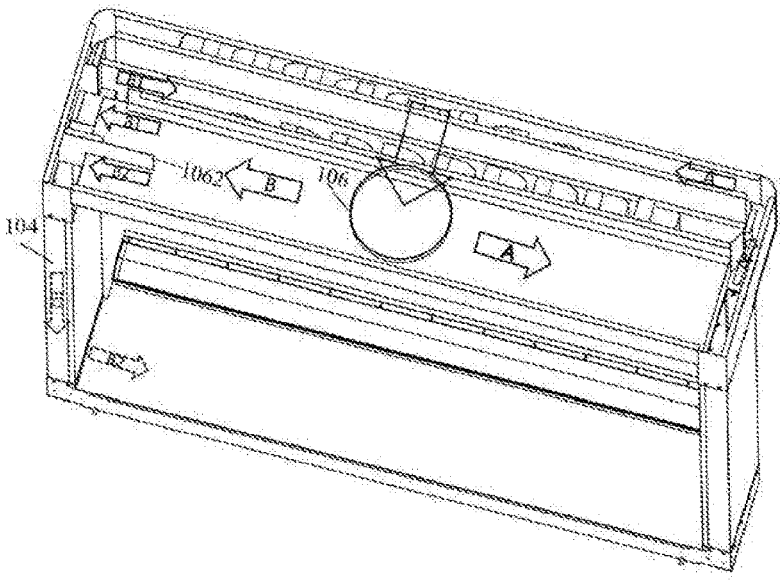
FIG. 10 is a perspective schematic illustration showing the air supply duct of a second embodiment of the ventilation apparatus provided by the present invention.

The ventilation apparatus provided with two of the steady flow structures which are arranged symmetrically in left and right is described hereinbefore, it is known to those skilled in the art that the present invention may also provide a ventilation apparatus that is merely provided with one steady flow structure at each air supply outlet based on the substance thereof, FIG. 9 shows a schematic view of an exterior structure of the air supply duct in this kind of ventilation apparatus. As the same with the first embodiment, the hood 101 is provided with three air supply outlets: a first air supply outlet 109 which is located at the upper portion of the front opening of the work chamber 102 and inside of the work chamber 102, and as shown in FIG. 2, supplies the air obliquely and downwardly toward the interior of the work chamber, a second air supply outlet 110 which is located at the lower portion of the front opening of the work chamber 102, and as shown in FIG. 2, supplies the air toward the interior of the work chamber; and a third air supply outlet 111 which is located at the upper portion of the front opening of the work chamber 102 and outside the work chamber 102, and as shown in FIG. 2, supplies the air downward vertically. In order to clearly show the specific direction of the supply airflow after the supply airflow enters into the air supply duct of the hood from the air supply inlet 106 located at the top of the hood, FIG. 10 shows the configuration of the air supply duct 1061 near the air supply inlet 106 when a top panel 119 of the hood 101 is opened; as indicated by the arrows in FIG. 10, after being supplied downward vertically from the air supply inlet 106, the supply airflow is split below the air supply inlet 106 into two paths A and B, and flows to left and right sides of the hood; after being redirected by the side walls, the airflow in path A is connected with the third air supply outlet directly, and blows from left side of the hood rightward into the steady flow structure inside the third air supply outlet; and the right path airflow B is split again into two paths, i.e., a front path Bland a rear path B2, by the flow-dividing sheet 1062 at the position near the right side wall of the hood; the front path airflow B1 is delivered through the air supply duct to the first air supply outlet, and blows from the right side of the hood leftward into the steady flow structure located inside the first air supply outlet; the rear airflow B2 is guided into the hollow right side wall 104 of the hood, delivered by the right side wall 104 to be near the second air supply outlet, and blows leftward into the steady flow structure inside the second air supply outlet from the right side of the hood.

Figure 11A:
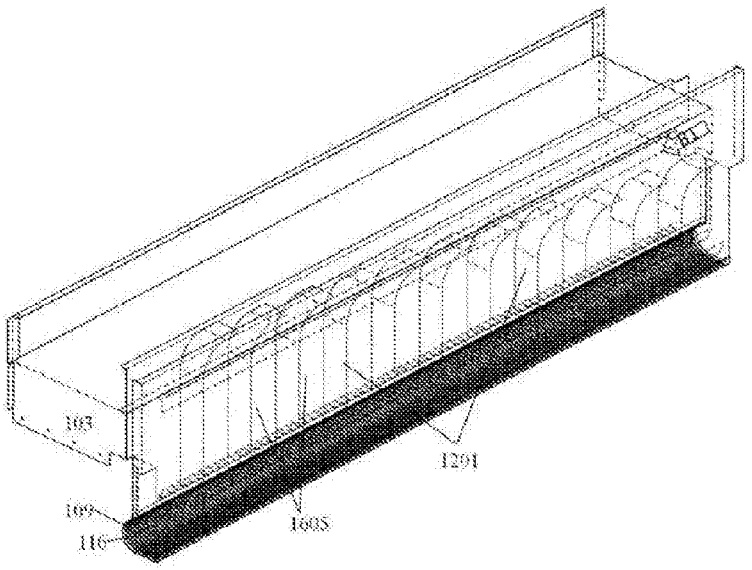
FIG. 11*a* is a perspective schematic illustration showing the structure near the first air supply outlet according to the second embodiment of the ventilation apparatus provided by the present invention.

The aforementioned ventilation apparatus 100 is provided with one steady flow structure on the inner side of each air supply outlet, before the supply airflow blows out from the air supply outlets, to rectify turbulent flow and control airflow directions, thus to ensure that the supply air blowing out from each air supply outlet are steady flows along predetermined directions. FIG. 11 is schematic view of the structure near the first air supply outlet 109. As shown in FIG. 11*a*, after flowing through the steady flow structure 120 (see FIG. 11*d*), the supply airflow A12 and B12 from the right side of the hood are split by the steady flow structure into plurality of airflow paths 1065, and led by an air outlet guide plate 1203 to finally blow out from the air supply outlet 109.

Figure 11B:
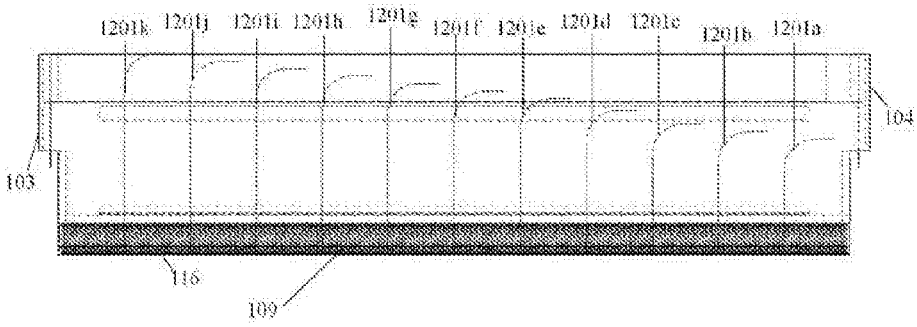
FIG. 11*b* is a front view illustrating the structure near the first air supply outlet according to the second embodiment of the ventilation apparatus provided by the present invention.
Figure 11C:
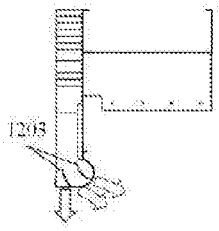
FIG. 11*c* is a right view illustrating the structure near the first air supply outlet according to the second embodiment of the ventilation apparatus provided by the present invention.
Figure 11D:
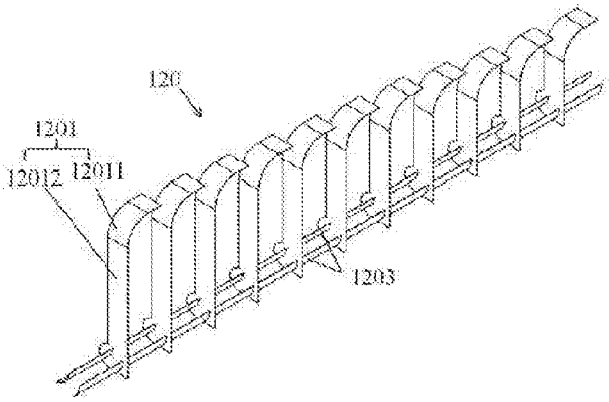
FIG. 11*d* is a perspective view illustrating the steady flow structure near the first air supply outlet according to the second embodiment of the ventilation apparatus provided by the present invention.
Figure 12A:
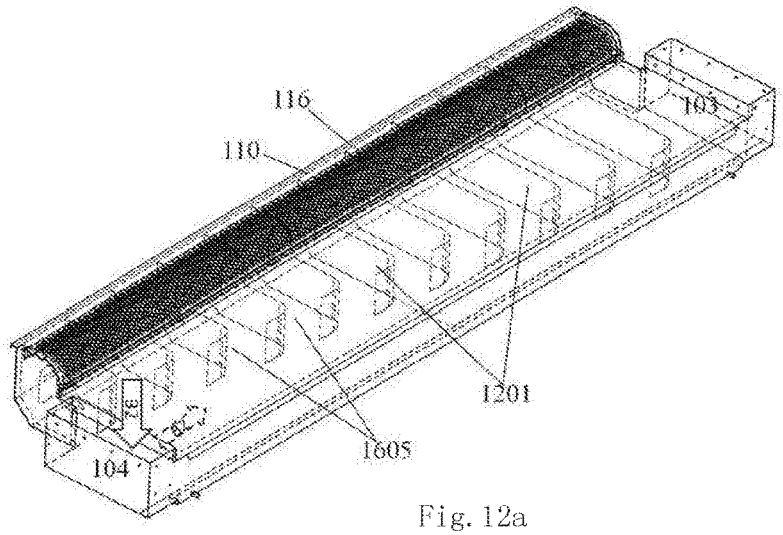
FIG. 12*a* is a perspective schematic illustration showing the structure near the second air supply outlet according to the second embodiment of the ventilation apparatus provided by the present invention.
Figure 12B:
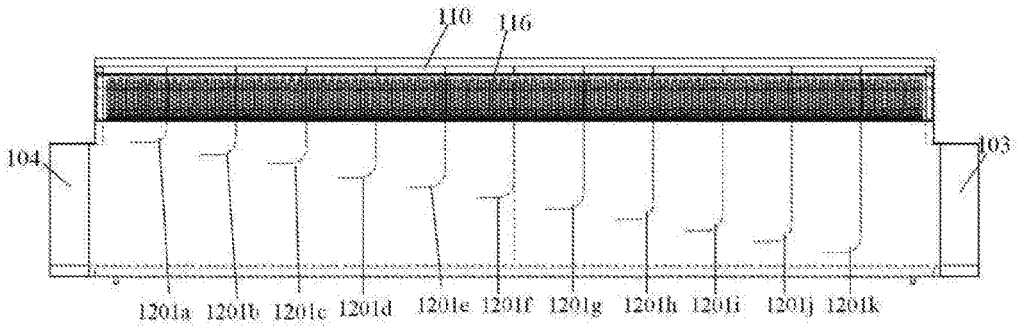
FIG. 12*b* is a front view illustrating the structure near the second air supply outlet according to the second embodiment of the ventilation apparatus provided by the present invention.
Figure 12C:
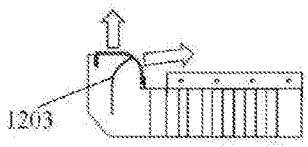
FIG. 12*c* is a left view illustrating the structure near the second air supply outlet according to the second embodiment of the ventilation apparatus provided by the present invention.
Figure 12D:
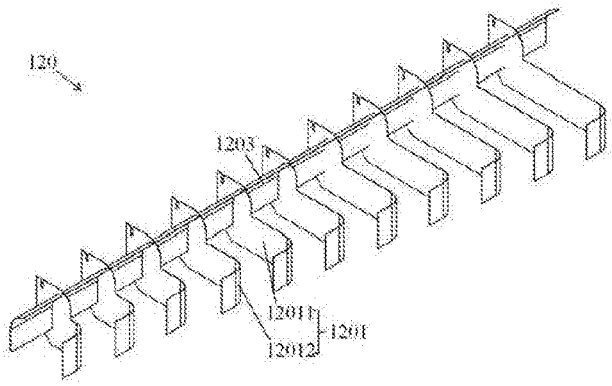
FIG. 12*d* is a perspective view illustrating the steady flow structure near the second air supply outlet according to the second embodiment of the ventilation apparatus provided by the present invention.
Figure 13A:
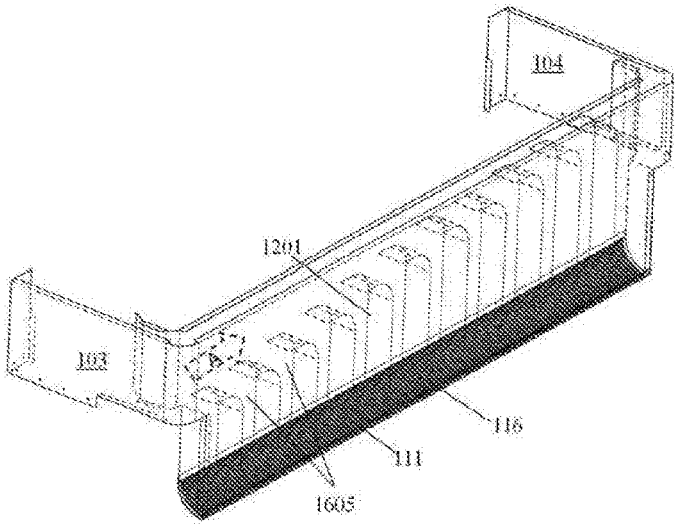
FIG. 13*a* is a perspective schematic illustration showing the structure near the third air supply outlet according to the second embodiment of the ventilation apparatus provided by the present invention.
Figure 13B:
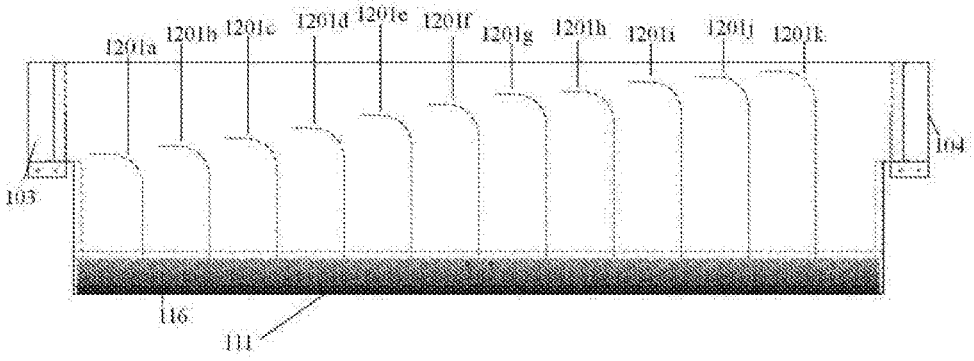
FIG. 13*b* is a front view illustrating the structure near the third air supply outlet according to the second embodiment of the ventilation apparatus provided by the present invention.
Figure 13C:
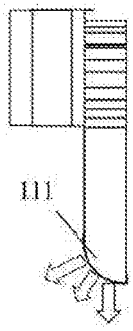
FIG. 13*c* is a left view illustrating the structure near the third air supply outlet according to the second embodiment of the ventilation apparatus provided by the present invention.
Figure 13D:
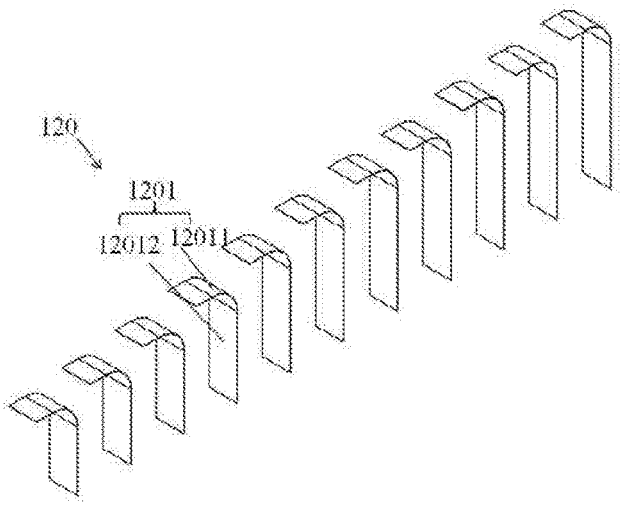
FIG. 13*d* is a perspective view illustrating the steady flow structure near the third air supply outlet according to the second embodiment of the ventilation apparatus provided by the present invention.

The configurations of the steady flow structure 120 is shown in FIG. 11*d*, each steady flow structure comprises a plurality of flow-guiding plates 1201 formed in a substantial L-shape, each flow-guiding plate 1201 includes an air catching plate 12011 which is one side of the L-shape and a longitudinal plate 12012 which is the other side of the L-shape; all the flow-guiding plates 1201 are arranged in a straight line, with the longitudinal plates 12012 of the flow-guiding plates being arranged in parallel with each other and all the air catching plates 12011 of the flow-guiding plates facing a same direction in which the airflow enters; ends of the longitudinal plates 12012 of all of the flow-guiding plates are aligned with each other, and lengths of the longitudinal plates are increased along the direction in which the airflow enters; both sides of all of the flow-guiding plates 1201 are seamlessly jointed to walls constructing the airflow duct so as to form airflow paths separated by the flow-guiding plates for directing the airflow from the air catching plate surfaces to the respective airflow paths 1065 and blown out along the longitudinal plates.

Preferably, all the flow-guiding plates 1201 of the steady flow structure 120 are arranged in a straight line with constant intervals, and the heights of all of the flow-guiding plates 1201 of the steady flow structure 120 are increased with equal differences along the direction in which the airflows enter (from 1201*a* to 1201*e*).

Still further, the steady flow structure 120 comprises two air outlet guide plates 1203 shaped as an arc, the air outlet guide plates are orthogonal to the longitudinal plates 12012 of all the flow-guiding plates, so as to change directions from which the airflows blown out from the air supply outlet.

More preferably, the air supply outlet 109 is provided with mesh grille 116 covering the air supply outlet.

Since both sides of each flow-guiding plate 1201 of the steady flow structure are seamlessly jointed to the air supply duct walls, as shown in FIG. 11*a*, after flowing in from the right end of the steady flow structure 120 (see FIG. 11*d*), the supply airflows A12 and B12 are respectively caught by the air catching plates 12011 of the flow-guiding plates in different heights into airflow paths 1065 constructed by corresponding flow-guiding plates and air supply duct walls; at the place where the directions of airflows are changed, the air catching plates 12011 are designed with arched surfaces for smoothly changing the directions of the airflows, preventing the formation of turbulent flows to the highest degree. FIGS. 11*b* and 11*c* are the front view and the left view of the structure near the first air supply outlet 109 respectively, the steady flow structure 120 (see FIG. 11*d*) is provided with eleven flow-guiding plates 1201*a*-1201*k* with the heights gradually increasing from 1201*a* to 1201*k*, thus, the supply airflow B12 is caught by the flow-guiding plates with different heights and are split into twelve branches as they flow towards the central separator plate 1202, the twelve branches flow downwardly along the L-shape configuration of corresponding flow-guiding plates. After the supply airflow B12 is split by twelve airflow paths 1065 respectively, their flow rates are decreased and then most of the turbulent flows are corrected by the flow-guiding plates into uniform laminar flows, and redirected to the directions indicated by arrows shown in FIG. 11*c* by the arc-shaped air outlet guide plates 1203, which are provided orthogonally with the longitudinal plates of all the flow-guiding plates and inside of the air supply outlet 109, and blows into the work chamber obliquely and downwardly from air supply outlet 109; the supply airflows in these directions effectively push the toxic gases located interiorly near the central portion of the work chamber. The mesh grille 116 arranged at the air supply outlet 109 further diffuse the supply airflows, thus to further ensure that uniform stable laminar airflows are supplied from the air supply outlet 109 to the work chamber.

Similarly, the steady flow structure near the second and third air supply outlets 110 and 101 and the airflow directions at corresponding locations are shown in FIGS. 12*a*-12*d*, 13*a*-13*d*; each of the two air supply outlets is provided with one steady flow structure 120 inside the air supply outlets before the supply airflow blows out from the air supply outlets, and as the directions in which the supply airflows blow are different, the steady flow structure within each air supply outset is set up differently. From FIGS. 12*a*-12*d*, 13*a*-13*d* and based on the descriptions in the first embodiment regarding the steady flow structures near the first, second and third air supply outlets and in the second embodiment regarding the first air supply outlet, those skilled in the art may clearly and accurately understand the distribution of the airflows in the second and third air supply outlets, thus the descriptions thereof is omitted herein; after flowing through the steady flow structures inside the second, third air supply outlets, the supply airflows are directed by the steady flow structures to the air supply outlets, and blow out evenly and stably along corresponding directions at the air supply outlets shown in FIG. 2*a*.

The preferred embodiment is described hereinbefore, whereas the present invention is not limited to this embodiment, and various modifications obtained without departing from the scope of the present invention belong to the scope of the present invention. For example, the number of the flow-guiding plates in the steady flow structure of the ventilation apparatus may be appropriately increased or decreased depending on the specific requirements. Further, in the above embodiments, two air supply outlets are provided in the upper portion of the hood; the lower portion of the hood is provided with one supply outlet; and an air exhaust duct is provided at the upper portion of the hood adjacent to the rear wall of the hood. However, the location and number of air supply outlets and the air exhaust ducts are not limited to this configuration as long as the push-pull airflow pattern can be formed in the work chamber.

The invention claimed is:

1. A steady flow structure used within an airflow duct, comprising a plurality of flow-guiding plates formed in a substantial L-shape, each flow-guiding plate includes an air catching plate which is a first side of the L-shape and a longitudinal plate which is a second side of the L-shape; wherein, a set of the plurality of flow-guiding plates includes a first subset of flow-guiding plates and a second subset of flow-guiding plates;

longitudinal plates of the flow-guiding plates being arranged in parallel with each other and all of the air catching plates of the first subset of the flow-guiding plates facing a first direction in which a first airflow enters and all of the air catching plates of the second subset of the flow-guiding plates facing a second direction in which a second airflow enters, wherein the first direction is opposite to the second direction;

ends of the longitudinal plates of all of the flow-guiding plates of the first subset are aligned with each other, ends of the longitudinal plates of all of the flow-guiding plates of the second subset are aligned with each other, and lengths of the longitudinal plates are increased along the direction in which the first and second airflow enters, wherein the air catching plates include arched surfaces, and the lengths of the air catching plates are substantially the same;

at both the first and second sides of the flow-guiding plates, all of the flow-guiding plates are jointed to walls constructing the airflow duct so as to form airflow paths separated by the flow-guiding plates for directing the airflow from the air catching plates to the respective airflow paths and blown out along the longitudinal plates, wherein the first subset of flow-guiding plates are configured to redirect the first airflow from the first direction to a third direction and the second subset of flow-guiding plates are configured to redirect the second airflow from the second direction to the third direction.

2. The steady flow structure according to claim 1, wherein all of the flow-guiding plates are arranged in a straight line with constant intervals.

3. The steady flow structure according to claim 2, wherein heights of all of the flow-guiding plates increase with equal differences along the direction in which the airflow enters.

4. A ventilation apparatus, comprising:

a hood arranged indoors, an inner chamber of the hood constituting a work chamber and a front wall of the hood being formed with a front opening which opens toward indoor environment;

an air supply duct, which supplies air into the work chamber through air supply outlets which are provided on the hood and extend in the left-right width direction of the work chamber; and an air exhaust duct, through which the air entering the work chamber through the front opening and the air entering the work chamber through the air supply outlets are exhausted from the work chamber to outside, characterized in that:

a steady flow structure is provided within the air supply duct, the steady flow structure comprises a plurality of flow-guiding plates formed in a substantial L-shape, each flow-guiding plate including an air catching plate which is a first side of the L-shape and a longitudinal plate which is a second side of the L-shape; wherein, a set of the plurality of flow-guiding plates includes a first subset of flow-guiding plates and a second subset of flow-guiding plates;

longitudinal plates of the flow-guiding plates being arranged in parallel with each other and all of the air catching plates of the first subset of the flow-guiding plates facing a first direction in which a first airflow enters and all of the air catching plates of the second subset of the flow-guiding plates facing a second direction in which a second airflow enters, wherein the first direction is opposite to the second direction;

ends of the longitudinal plates of all of the flow-guiding plates of the first subset are aligned with each other, ends of the longitudinal plates of all of the flow-guiding plates of the second subset are aligned with each other, and lengths of the longitudinal plates are increased along the direction in which the first and second airflow enters, wherein the air catching plates include arched surfaces, and the lengths of the air catching plates are substantially the same;

at both the first and second sides of the flow-guiding plates, all of the flow-guiding plates are jointed to walls constructing the airflow supply duct so as to form airflow paths separated by the flow-guiding plates for directing the airflow from the air catching plates to the respective airflow paths and blown out along the longitudinal plates, wherein the first subset of flow-guiding plates are configured to redirect the first airflow from the first direction to a third direction and the second subset of flow-guiding plates are configured to redirect the second airflow from the second direction to the third direction;

supply airflow then blows out evenly and stably along the air supply outlets located at sides of the steady flow structure after flowing through the steady flow structure.

5. The ventilation apparatus according to claim 4, wherein all the flow-guiding plates of the steady flow structure are arranged in a straight line with constant intervals.

6. The ventilation apparatus according to claim 5, wherein heights of all the flow-guiding plates of the steady flow structure increase with equal differences along the direction in which the airflow enters.

7. The ventilation apparatus according to claim 4, wherein two steady flow structures are provided symmetrically in left and right at the inner side of the air supply outlet, and the two steady flow structures are arranged in a straight line and form a configuration having a larger height in the middle than at left and right ends; the airflow enters in from the left and right ends, respectively, and then, after flowing through the steady flow structures, blows out evenly and stably from the air supply outlets located along the sides of the two steady flow structures.

8. The ventilation apparatus according to claim 7, wherein a central separator plate is provided between the two steady flow structures, at the center position of the straight line, and is provided in parallel with the longitudinal plates of all the flow-guiding plates; each side of the central separator plate is jointed to walls constituting the air supply duct, such that the supply airflow entering the steady flow structures from the left direction and from the right direction are separated from each other.

9. The ventilation apparatus according to claim 8, wherein the air supply outlets includes a first air supply outlet located at an upper portion of the front opening of the work chamber and inside of the work chamber, wherein the air supply outlet supplies the air obliquely and downwardly toward the interior of the work chamber.

10. The ventilation apparatus according to claim 9, further comprising a second air supply outlet located at a lower portion of the front opening of the work chamber, wherein the second air supply outlet supplies the air toward the interior of the work chamber.

11. The ventilation apparatus according to claim 9, wherein the steady flow structure further comprises an air outlet guide plate orthogonal to the longitudinal plates of all of the flow-guiding plates and inside the air supply outlet, so as to change the direction from which the airflow blows out from the air supply outlet.

12. The ventilation apparatus according to claim 10, wherein comprising a third air supply outlet located at the upper portion of the front opening of the work chamber and outside of the work chamber, wherein the third air supply outlet supplies the air downwardly.

13. The ventilation apparatus according to claim 9, wherein each air supply outlet is provided with a mesh grille for covering the air supply outlet.

14. The ventilation apparatus according to claim 12, wherein an air supply inlet of the air supply duct is provided above the work chamber.

15. The ventilation apparatus according to claim 14, wherein left and right side walls of the hood are hollow structures respectively, for connecting the air supply inlet with the air supply outlet located at the lower portion of the work chamber.

16. The ventilation apparatus according to claim 12, wherein the air exhaust duct is located inside the work chamber and near a rear portion of the hood; the air exhaust duct extends in left-right width direction of the work chamber, and an air exhaust outlet of the air exhaust duct is provided above the work chamber such that the airflow entering into the air exhaust duct is exhausted to the outside of the work chamber.

17. The ventilation apparatus according to claim 16, wherein the air exhaust duct is constituted by the hood and three air baffles, which are an top, a middle and a bottom air baffles at the rear portion of the work chamber, wherein the bottom air baffle is vertically arranged at a lower portion of the work chamber, with a plurality of through holes opened thereon, and the plurality of through holes are distributed over an entire left-right width direction of the lower air baffle;

the middle air baffle is located above the lower air baffle, and is provided to be oblique in a direction toward a rear wall of the hood;

the top air baffle is located above the middle air baffle, and is provided to be oblique in a direction toward an upper wall of the hood; gaps are provided among the top, middle and bottom air baffles, and between the top, middle and bottom air baffles and inner walls of the hood;

airflow in the work chamber flows into the air exhaust duct through the through holes and the gaps and is exhausted through the air exhaust outlet to outdoors.

18. The ventilation apparatus according to claim 17, wherein the work chamber is provided with an inclined top wall placed toward a position between the top air baffle and the inclined top wall of the hood from the first air supply outlet.

19. The ventilation apparatus according to claim 18, wherein a work light for illuminating the work chamber is provided within the inclined top wall.

* * * * *